US005336430A

United States Patent [19]

Bahary et al.

[11] Patent Number: 5,336,430

[45] Date of Patent: * Aug. 9, 1994

[54] LIQUID DETERGENT COMPOSITION CONTAINING BIODEGRADABLE STRUCTURANT

[75] Inventors: William S. Bahary, Pearl River, N.Y.; Michael P. Hogan, Rochelle Park, N.J.

[73] Assignee: Lever Brothers Company, Division of Conopco, Inc., New York, N.Y.

[ * ] Notice: The portion of the term of this patent subsequent to Jul. 27, 2010 has been disclaimed.

[21] Appl. No.: 970,725

[22] Filed: Nov. 3, 1992

[51] Int. Cl.[5] ..... C11D 3/22; C11D 3/395; C11D 17/08

[52] U.S. Cl. ..... 252/174.17; 252/95; 252/99; 252/105; 252/135; 252/174.13; 252/DIG. 14

[58] Field of Search ..... 252/174.24, 174.23, 252/DIG. 2, 174.17, 174.18, 174.13, 95, 99, 105

[56] References Cited

U.S. PATENT DOCUMENTS

| | | | |
|---|---|---|---|
| 3,060,124 | 10/1962 | Ginn | 252/174.24 |
| 3,671,440 | 6/1972 | Sabatelli et al. | 252/103 |
| 3,721,627 | 3/1973 | Adams et al. | 252/174.24 |
| 4,167,488 | 9/1979 | Murtaugh | 252/160 |
| 4,226,736 | 10/1980 | Bush et al. | 252/174.24 |
| 4,260,528 | 4/1981 | Fox et al. | 252/525 |
| 4,260,858 | 4/1981 | Fox et al. | 252/DIG. 14 |
| 4,579,676 | 4/1986 | Bull | 252/95 |
| 4,752,409 | 6/1988 | Drapier et al. | 252/94 |
| 4,830,783 | 5/1989 | Ellis et al. | 252/155 |
| 4,836,948 | 6/1989 | Corring | 252/99 |
| 4,846,993 | 7/1989 | Lentsch et al. | 252/174.24 |
| 4,935,065 | 6/1990 | Bull | 252/174.24 |
| 4,941,988 | 7/1990 | Wise | 252/99 |
| 4,965,012 | 10/1990 | Olson | 252/174.12 |
| 5,190,594 | 3/1993 | Chou et al. | 252/155 |
| 5,200,236 | 4/1993 | Lang | 252/174.12 |
| 5,230,822 | 7/1993 | Kamel et al. | 252/174.13 |
| 5,258,132 | 11/1993 | Kamel et al. | 252/94 |

OTHER PUBLICATIONS

Copending application: Tomlinson-Ser. No. 07/945,181-Filed Sep. 15, 1992.

*Primary Examiner*—Paul Lieberman
*Assistant Examiner*—A. Hertzog
*Attorney, Agent, or Firm*—A. Kate Huffman

[57] ABSTRACT

A liquid automatic dishwashing composition containing a biodegradable structurant, such a microbial polysaccharide or a superabsorber, in combination with a wax encapsulated source of a chlorine bleaching agent and a chlorine scavenger to degrade small amounts of chlorine agent leaking from the encapsulates.

10 Claims, No Drawings

LIQUID DETERGENT COMPOSITION CONTAINING BIODEGRADABLE STRUCTURANT

FIELD OF THE INVENTION

The present invention relates to liquid detergent compositions for automatic dishwashers that contain a biodegradable structurant system and an encapsulated chlorine bleach agent.

BACKGROUND OF THE INVENTION

Liquid detergents for automatic dishwashers have been commercialized since the mid 1980s. These detergents have overcome many problems encountered with automatic dishwashing detergent powders. For example, powder detergents lose solubility on aging, cake in the dispenser cup and create dusting generated by fine particles when dispensed.

However, automatic dishwashing liquids, (ADLs) present a challenge to detergent artisans in terms of structuring the compositions to provide consumer acceptable viscosities. For example, clays have historically been used, however, such structurants are deficient.

Further, cross-linked acrylic polymers having a molecular weight of greater than about 1,000,000 have also been used as structurants, however, such polymers may be quite expensive and not cost effective, as well as being non-biodegradable.

Structurants which are biodegradable, such as naturally occurring polysaccharide gums or biopolymeric gums produced by microbial fermentation of sugars have been used as preferred alternatives to the above discussed structurants. Such gums are, however, highly sensitive to chlorine agents and cannot be used in liquid compositions unless the chlorine agent can be encapsulated (see Fox et al., U.S. Pat. No. 4,260,528).

Even in combination with encapsulated bleach, such biodegradable structurants were observed to degrade by residual bleach or by the hypochlorite leaking from the encapsulates. In these prior art compositions, the structurants are even more chlorine sensitive than enzymes present in the compositions.

SUMMARY OF THE INVENTION

It is therefore an object of the present invention to obtain an automatic dishwashing liquid composition having a biodegradable structurant system in combination with encapsulated bleach agents.

Another object of the invention is to provide a liquid composition which possesses a rheology effective for cup retention and dispensing.

Finally, it is an object of the present invention to provide a liquid composition which is more cost effective than formulations which depend upon the use of synthetic polymer thickeners to structure the formulations.

The objects of the present invention are accomplished by providing the inventive liquid detergent compositions which comprise:

a) a biodegradable structurant selected from the group of
   i) 0.1 to 0.5 wt. % of a microbial polysaccharide structurant, preferably a xanthan gum, or
   ii) 0.5% to about 2.5% of a superabsorber which is a hydrolyzed poly(acrylonitrile) or a hydrolyzed starch-graft-poly(acrylonitrile);

b) 10 to 40% of a builder;
c) 0 to 25% of an alkalinity agent;
d) 0.01 to 1% of a chlorine scavenger agent;
e) 1 to 5% of an available chlorine source, the chlorine source being encapsulated in a paraffin wax coating; and
f) water.

DETAILED DESCRIPTION OF PREFERRED EMBODIMENTS

Certain biodegradable structurants may be used to structure the inventive liquid detergent formulation to provide a viscosity range of about 5,000 to about 70,000 cps, measured by using a Brookfield Viscometer at 3 rpm. The structurants of the invention provide stable compositions which also have satisfactory flow properties and good cup retention.

Biodegradable structurants which may be used include three classes:

(1) microbial polysaccharides;
(2) superabsorber structurants; and
(3) other polysaccharides.

The microbial polysaccharides are those which are produced by bacteria and which may be used as thickeners in liquid autodish formulations. A selected microbial polysaccharide should be present in the invention in an amount of 0.1 to 0.5 wt. %, preferably 0.1 to 0.35 wt. %.

Microbial polysaccharides which may be used include:

(1) xantham gums: Kelzan® gum supplied by Kelco Corp. of San Diego, Calif., Rhodigel® gum series and Rhodopol® gum series supplied by Rhone-Poulenc of Cranbury, N.J.;
(2) a biopolymeric gum with a backbone of D-glucose, D-glucoronic acid, D-glucose and L-rhamnose repeat units with a two glucose residue side chain: such as Rhamsan® gum supplied by Kelco Corp.;
(3) a biopolymeric gum with a backbone identical to Rhamsan but the side chain is of a mannose or a L-rhamnose unit such as Whelon® gum, supplied by Kelco Corp.;

A superabsorber used as a structurant should be present in the formulations in an amount of from 0.5 wt. % to about 2.5 wt. %, preferably 0.1 wt. % to 1.5 wt. %. Superabsorbers useful in the invention include: hydrolyzed poly(acrylonitrile), a hydrolyzed astarch-graft-poly(acrylonitrile) or mixtures thereof such as the Water Lock® superabsorber series supplied by Grain Processing Corp. of Muscatine, Iowa;

Other polysaccharides which may be useful are present in the formulations in an amount of 0.5 wt. % to about 25 wt. % and include a carboxymethylcellulose (CMC 12M31 supplied by Aqualon of Wilmington, Del.); a guar gum (Jaguar® A40F supplied by Rhone-Poulenc of Cranbury, N.J.); a locust bean gum galactomannan from Rhone-Poulenc and Kronjac flour, a glucomannan (Nutricol® K80V supplied by FMC Corp. of Princeton, N.J.); a hydroxy ethyl cellulose (Natrosol® supplied by Aqualon of Wilmington, Del.); a carrageenan, and any other polysaccharide known in the art which yields the desired viscosities.

The preferred structurants include xanthan gum, the superabsorbers including hydrolyzed polyacrylonitrile and hydrolyzed starch-graft-polyacrylonitrile, guar gum and carboxymethyl cellulose. Especially preferred is xanthan gum.

Scavenger

A scavenger is useful to substantially reduce the presence of a free chlorine source, HOCL and other oxidizing chlorine containing compositions to $Cl^-$ ions or to substantially reduce hydrogen peroxide or peroxy acid bleaches to unoxidized species.

Useful scavengers include sulfur-oxyacids and salts thereof. Most preferred are the alkali metal and ammonium salts of sulfur-oxyacids including sodium bisulfite ($NaHSO_3$), ammonium sulfite ($(NH_4)_2SO_3$), sodium sulfite ($Na_2SO_3$) sodium thiosulfite ($Na_2S_2O_3$), sodium metabisulfite ($Na_2S_2O_3$), potassium metabisulfite ($K_2S_2O_5$), lithium hydrosulphite ($Li_2S_2O_4$), or other reducing agents potassium iodide (KI), ferrous ammonium sulfate [$Fe(NH_4SO_4)_2$]. The preferred scavenger for chlorine is sodium bisulfite.

The chlorine scavenger agent should be present in the invention in an amount about equimolar to the amount of free chlorine in the composition. Sodium bisulfite is about equimolar to sodium hypochlorite. Because of disadvantages of using large amounts of scavenger it is preferable to have no greater than about 0.4 wt. % free hypochlorite in the composition and more preferably not more than 0.1% free hypochlorite available in the composition for the life of the product, defined herein as about one year at room temperature. The amount of free hypochlorite in the compositions is determined by the integrity of the encapsulates containing the chlorine agent in preventing chlorine leakage. Thus, the preferred amount of scavenger in the compositions is about 0.01 wt. % to about 1 wt. %.

Encapsulated Bleach Source

The wax encapsulates used in the invention are stable in an alkaline environment and comprise 10–80 wt. % of a core material in the form of a core particle or an aggregate of core particles which are nonfriable, water soluble or water dispersible or which dissolve, disperse or melt in a temperature range of from about 40° to about 50° C. and 20–90% by weight of a continuous coherent waxy coating consisting essentially of one or more paraffin waxes having a melting point of from about 40° C. to about 50° C., a solids content of from about 35 to 100% at 40° C. and a solids content of from 0 to about 15% at 50° C. and the encapsulates are from 100 to 1,500 microns thick.

The encapsulates preferably contain a plastic wax additive (also referred to as wax plasticizer) or a flow aid material as described in U.S. Patent application No. 07/688,691 (Kamel et al.) now U.S. Pat. No. 5,230,822, herein incorporated by reference. The preferred wax additive is hydrogenated methyl ester of resin known as Hercolyn D® product supplied by Hercules, Inc. of Wilmington, Del. and the preferred wax flow aid is calcium silicate supplied as Hubersorb 600® product supplied by J. M. Huber.

It may be appreciated that wax encapsulates may be produced by encapsulation techniques and with coating materials known in the art which would produce coherent waxy coatings which are stable in an alkaline environment. Such materials may include fatty acids, microcrystalline wax, polymeric materials, etc.

A wide variety of halogen and oxygen bleach sources may be encapsulated for use in the present invention as described in co-pending applications, Ser. No. 688,691 (Kamel et al.), now U.S. Pat. No. 5,230,822, and Ser. No. 688,692 issued as U.S. Pat. No. 5,200,236 (Lang et al.) now allowed, herein incorporated by reference.

The core material of the encapsulates used in the present invention preferably are chlorine bleach sources including potassium and sodium dichloroisocyanurate dihydride. Such sources should be present at a level which provides about 0.2 to about 3.0% available chlorine. Other hypohalite liberating compounds may also be employed in the inventive dishwashing detergents at a level of from 0.5 to 5% by weight, preferably from 0.5 to 3% by weight.

Silicates

Alkaline metal silicates may be employed as cleaning ingredients, as a source of alkalinity, metal corrosion inhibitors, and protectors of overglaze on china tableware. An especially preferred silicate is sodium silicate having a ratio of SiO2:Na2O of from about 1.0 to about 3.3, preferably from about 2 to about 3.2. Potassium silicate may also be used as an alkalinity source. The alkalinity source is preferably used in the invention in either solid or aqueous form up to about 25%, preferably from about 3 to about 20%.

Surfactants

Nonionic surfactants are generally preferred for use in automatic dishwashing detergents. Preferably they should be the defoaming type and where appropriate they can be used in an amount from about 0.2 to about 8%, preferably from about 1 to about 4%. Nonionic synthetic detergents can be broadly defined as compounds produced by the condensation of alkylene oxide groups with an organic hydrophobic compound which may be aliphatic or alkyl aromatic in nature. The length of the hydrophilic or polyoxyalkylene radical which is condensed with any particular hydrophobic group can be readily adjusted to yield a water soluble compound having the desired degree of balance between hydrophilic and hydrophobic elements.

Examples of the various chemical types suitable as nonionic surfactants include: polyoxyethylene and/or polyoxypropylene condensates of aliphatic carboxylic acids, aliphatic alcohols and alkylphenols; polyoxyethylene derivatives of sorbital mono-, di-, and tri-fatty acid esters and polyoxyethylene - polyoxypropylene block polymers as described in U.S. Pat. No. 4,973,419, herein incorporated by reference.

Alkoxylated nonionics are also useful in the invention because of the encapsulation of the chlorine bleach as described above.

Co-structurants or Stabilizers

Co-structurants or stabilizers may also be used in combination with the biodegradable surfactants. Examples of such preferred co-structurants and stabilizers include: (1) alumina described in U.S. Pat. No. 4,836,948, herein incorporated by reference, (2) alkaline metal silica aluminate described in U.S. Pat. No. 4,941,988, herein incorporated by reference, (3) polyvalent metal soaps described in U.S. Pat. No. 4,752,409, herein incorporated by reference and (4) a synthetic hectorite clay such as Laponite XLS supplied by Waverly Mineral Products Co., subsidiary of LaPorte, Inc., of Bala Cynwd, Pa. 19004.

Preferred co-structurants include alumina and the hectorite clays. The co-structurants may be used in a range of from about 0.005 to 1%; preferably about 0.01 to about 0.5%; and especially preferred about 0.01 to about 0.1%.

The Detergency Builder

Soluble detergency builder salts useful herein can be of the polyvalent inorganic and polyvalent organic types, or mixtures thereof. Non-limiting examples of suitable water-soluble, inorganic alkaline detergency builder salts include the alkali metal carbonates, borates, phosphates, pyrophosphates, tripolyphosphates, bicarbonates and silicates. Specific examples of such salts include the sodium and potassium tetraborates, bicarbonates, carbonates, tripolyphosphates, orthophosphates and hexametaphosphates.

Examples of suitable organic alkaline detergency builder salts are (1) water-soluble amino polyacetates, e.g. sodium and potassium ethylenediamine tetraacetates, nitrilotriacetates and N-(2-hydroxyethyl)nitrilodiacetates; (2) water-soluble salts of phytic acid, e.g., sodium and potassium phytates; (3) water-soluble polyphosphates, including sodium, potassium and lithium salts of ethane-1-hydroxy-1, 1-diphosphonic acid; sodium, potassium and lithium salts of methylenediphosphonic acid and the like.

Additional organic builder salts useful herein include the polycarboxylate materials described in U.S. Pat. No. 2,264,103, including the water-soluble alkali metal salts of mellitic acid and citric acid, dipicolinic acid, oxydisuccinic acid and alkenyl succinates. The water-soluble salts of polycarboxylate polymers and copolymers, such as are described in U.S. Pat. No. 3,308,067, are also suitable herein.

It is to be understood that, while the alkali metal salts of the foregoing inorganic and organic polyvalent anionic builder salts are preferred for use herein from an economic standpoint, the ammonium, alkanolammonium, e.g., triethanolanumonium, diethanolammonium, and the like, water-soluble salts of any of the foregoing builder anions are useful herein.

Another class of suitable builders is that of the so-called water-insoluble calcium ion exchange builder materials. Examples thereof include the various types of water-insoluble crystalline or amorphous alumino silicates, of which zeolites are the best known representatives. Other useful materials are, for example, the layered silicates, such as a product sold by Hoechst under the trade name SKS-6.

Mixtures of organic and/or inorganic builder salts can also be used herein.

While any of the polyvalent builder materials are useful herein, the compositions of the invention are preferably free of phosphate builders for environmental and ecological reasons.

Preferred builders for use in the invention are sodium citrate, sodium carbonate, and sodium bicarbonate and mixtures thereof, or the potassium salts thereof. The potassium salts may be preferred for solubility reasons.

Preferably, the amount of builders in the composition is from about 10 to 40% by weight, more preferably from 15 to about 25% by weight.

Enzymes

Enzymes are used for many purposes in various fields where biochemical reactions occur. In general, an enzyme can be described as a catalyst capable of permitting a biochemical reaction to quickly occur and can be classified according to the type of reaction they catalyze. Enzymes are characterized by a high specificity, that is to say, each enzyme can catalyze a single reaction of one substance or a very small number of closely related substances.

Examples of enzymes suitable for use in the cleaning compositions of this invention include lipases, proteases, peptidases, amylases (amylolytic enzymes) and others which degrade, alter or facilitate the degradation or alteration of biochemical soils and stains encountered in cleansing situation so as to remove more easily the soil or stain from the object being washed to make the soil or stain more removable in a subsequent cleansing step. Both degradation and alteration can improve soil removability. Well known and preferred examples of these enzymes are proteases, lipases and amylases. Examples of such enzymes include Termamyl® amylase; Esperase® protease and Savinase® protease all supplied by Novo Industri A/S Copenhagen, Denmark;

The enzyme may be used in the composition from 0.005% to 5%, preferably 0.1% to 3 wt. %

Buffering Agents

In the instant compositions, it is generally desirable to also include one or more buffering agents capable of maintaining the pH of the compositions within the alkaline range. It is in this pH range that optimum performance of the bleach and surfactant are realized, and it is also within this pH range wherein optimum composition chemical stability is achieved.

High pH values such as those maintained by an optional buffering agent serve to enhance the soil and stain removal properties during utilization of the present compositions.

Any compatible material or mixture of materials which has the effect of maintaining the composition pH within the alkaline pH range, and preferably within the 10.5 to 12.5 range, can be utilized as the buffering agent in the instant invention. Such materials can include, for example, various water-soluble, inorganic salts such as the carbonates, bicarbonates, sesquicarbonates, silicates, pyrophosphates, phosphates, tetraborates, and mixtures thereof. Examples of materials which can be used either alone or in combination as the buffering agent herein include sodium carbonate, sodium bicarbonate, potassium carbonate, sodium sesquicarbonate, sodium silicate, sodium pyrophosphate, tetrapotassium pyrophosphate, tripotassium phosphate, trisodium phosphate, anhydrous sodium tetraborate, sodium tetraborate pentahydrate, potassium hydroxide, sodium hydroxide, and sodium tetraborate decahydrate.

Optional Ingredients

Optional ingredients such as colorants, dyes, pigments, perfumes, anti-tarnish agents, enzymes, hydrotropes and mixtures thereof may also be present.

Bleach sensitive dyes such as those described in U.S. Pat. No. 4,464,281 (Rapisarda et al.) may also be used in the invention because of the bleach encapsulates.

Alternatively, pigments such as Ultramarine Blue 5151 or Ultramarine Blue 17 may also be used. Additionally, any colorants or dye known in the art in a liquid detergent composition may be used.

Perfumes may be tailored for use in the compositions to provide various aromas and fragrances desired by the consumer as known in the art.

If additional defoaming is desired, silicones such as a polydimethyl siloxane with 6% hydrophobed silica supplied as anti-foam DB-100® by Dow Corning of Midland, Mich. may be used.

The amount of each optional additive is no greater than about 1% by weight.

The following examples will serve to distinguish this invention from the prior art and illustrate its embodiments more fully. Unless otherwise indicated, all parts, percentages and proportions referred to are by weight.

EXAMPLE 1

A typical prior art liquid composition for an automatic dishwashing detergent is:

| | |
|---|---|
| Carbopol 940[1] | 0.85% |
| Laponite XLS[2] | 0.010 |
| Sodium tripolyphosphate | 17.0 |
| Polytergent SLF-18[3] | 2.0 |
| D-Silicate[4] | 10.0 |
| NaOH | 0.7 |
| Perfume | 0.050 |
| Paraffin Wax Encapsulates with a halogen bleach core | 2.70 |
| Water | 100 |

[1]A cross-linked polyacrylate of greater than 1,000,000 daltons MW supplied by B. F. Goodrich of Cleveland, OH.
[2]A hectorite clay supplied by Waverly Mineral Products Co., of Bala Cynwd, PA.
[3]An alkoxylated hydrotropic surfactant supplied by Olin Corp. of Stamford, CT.
[4]A disilicate having a ratio of $Si:O_2:Na_2O$ of 2.0 supplied by PQ Corp. of Valley Forge, PA.

The wax encapsulates of the composition were prepared with a Boler ® paraffin wax coating and 1% of the wax additive Hercolyn D. The core is composed of Clearon CDB-56 bleach particles. About 50% of the encapsulates were composed of the paraffin wax coating. The encapsulates were prepared as described in Kamel, Ser. No. 07/688,691 now U.S. Pat. No. 5,230,822, herein incorporated by reference. Specifically a fluidized bed spray mode (i.e., Wurster) using a Glatt GPCG-5 fluidized spray bed unit was utilized. The parameters used were: bed weight 17.5 lbs., air flow rate 200–270 cfm., inlet air temperature 18°–24° C., coating rate 72 g/min, coating temperature 75°–80°C., batch time 70 minutes. After preparation of the encapsulates a coating of calcium silicate supplied as 0.075 wt. % Hubersorb 600 was added by blending the encapsulates and Hubersorb in a standard V-blender for 15 minutes.

The composition was prepared as follows for a 1000 g batch. Premix I containing 1.0 g. Laponite XLS in 49 g water was thoroughly mixed using a propeller mixer. Premix II was prepared by stirring the structurant in 350 g. water till totally dispersed. In Premix III, to 170 g water, 226.7 g of a 44% active D-silicate was added, followed by 170 g STPP, 20 g Polytergent SLF-18, 14 g of a 50% active NaOH, 0.5 g. fragrance and 1.0 g sodium bisulfite for a total weight of 602.2 g. Then 5.0 g of Premix I was added to Premix II, which was then combined with Premix III. The remaining water was added followed by gently stirring in 27.0 g encapsulates.

EXAMPLES 2–5

The following aqueous autodish compositions were prepared, as described in Example 1.

| | Ex. 2 | Ex. 3 | Ex. 4 | Ex. 5 |
|---|---|---|---|---|
| Carbopol 940[1] | 0.70 | — | — | — |
| Xanthan gum[5] | — | 0.35 | 0.35 | — |
| Waterlock G-400[6] | — | — | — | 1.10 |
| Sodium bisulfite | 0.10 | — | 0.10 | — |
| Laponite XLS[2] | 0.01 | 0.01 | 0.01 | 0.01 |
| Sodium tripolyphosphate | 17.0 | 17.0 | 17.0 | 17.0 |
| Polytergent SLF-18[3] | 2.0 | 2.0 | 2.0 | 2.0 |
| D-Silicate[4] | 10.0 | 10.0 | 10.0 | 10.0 |
| NaOH | 0.7 | 0.7 | 0.7 | 0.7 |
| Fragrance | 0.05 | 0.05 | 0.05 | 0.05 |
| Paraffin Wax Encapsulates with a halogen bleach core | 2.70 | 2.7 | 2.7 | 2.7 |
| Water | To 100 | To 100 | To 100 | to 100 |

[1]A cross-linked polyacrylate of greater than 1,000,000 daltons MW supplied by B. F. Goodrich of Cleveland, OH.
[2]A hectorite clay supplied by Waverly Mineral Products Co., of Bala Cynwd, PA.
[3]An alkoxylated biodegradable hydrotrope supplied by Olin Corp. of Stamford, CT.
[4]A disilicate having a ratio of $Si:O_2:Na_2O$ of 2.0 supplied by PQ Corp. of Valley Forge, PA.
[5]Kelzan(R) gum supplied by Kelco Corp. of San Diego, Calif.
[6]A superabsorber supplied by Grain Processing Corp. of Muscatine, Iowa.

EXAMPLES 6–10

The following aqueous autodish compositions were prepared as described in Example 1.

| | Ex. 6 | Ex. 7 | Ex. 8 | Ex. 9 | Ex. 10 |
|---|---|---|---|---|---|
| Waterlock G-400[6] | 1.10 | — | — | — | — |
| Jaguar A40F[7] | — | 0.70 | 0.70 | — | — |
| CMC 12M31P[8] | — | — | — | 1.70 | 1.70 |
| Sodium bisulfite | 0.10 | — | 0.10 | — | 0.10 |
| Laponite XLS[2] | 0.01 | 0.01 | 0.01 | 0.01 | 0.01 |
| Sodium tripoly-phosphate | 17.0 | 17.0 | 17.0 | 17.0 | 17.0 |
| Polytergent SLF-18[3] | 2.0 | 2.0 | 2.0 | 2.0 | 2.0 |
| D-Silicate[4] | 10.0 | 10.0 | 10.0 | 10.0 | 10.0 |
| NaOH | 0.7 | 0.7 | 0.7 | 0.7 | 0.7 |
| Fragrance LD-2822 | 0.05 | 0.05 | 0.05 | 0.05 | 0.05 |
| Paraffin Wax Encapsulates with a halogen bleach core | 2.70 | 2.70 | 2.70 | 2.70 | 2.70 |
| Water | To 100 | To 100 | To 100 | To 100 | To 100 |

[1]A cross-linked polyacrylate of greater than 1,000,000 daltons MW supplied by B. F. Goodrich of Cleveland, OH.
[2]A hectorite clay supplied by Waverly Mineral Products Co., of Bala Cynwd, PA.
[3]An alkoxylated biodegradable hydrotrope supplied by Olin Corp. of Stamford, CT.
[4]A disilicate having a ratio of $Si:O_2:Na_2O$ of 2.0 supplied by PQ Corp. of Valley Forge, PA.
[5]Kelzan(R) supplied by Kelco Corp. of San Diego, Calif.
[6]A superabsorber supplied by Grain Processing Corp. of Muscatine, Iowa.
[7]Guar gum supplied by Rhone-Poulenc of Cranbury, NJ.
[8]A carboxy methylcellulose supplied by Aqualon of Wilmington, DE.

EXAMPLE 11

The formulas of Examples 3, 5, 7 and 9 contain biodegradable structurants and no sodium bisulfite. The formulas of Examples 4, 6, 8 and 10 contain the same biodegradable structurants with 0.1% sodium bisulfite. Examples 1 and 2 containing the polymer Carbopol 940 ® polymer are controls. The compositions without sodium bisulfite were compared with those containing sodium bisulfite to determine the percent syneresis produced in the compositions. The percent syneresis for each of the ten compositions is tabulated below:

TABLE 1

| | | | % SYNERESIS | | | |
|---|---|---|---|---|---|---|
| | | | w/o NaHSO3 | | With NaHSO3 | |
| Example No. | Structurant Type | Conc. (%) | Initial | 4 Wks @ 40° C. | 4 Wks @ RT | 4 Wks @ 40° C. |
| 1–2 | Carbopol 940 (Control) | 0.70 | 0.0 | 0.0 | 0.0 | 0.0 |

TABLE 1-continued

| Example No. | Structurant Type | Conc. (%) | % SYNERESIS w/o NaHSO3 Initial | 4 Wks @ 40° C. | With NaHSO3 4 Wks @ RT | 4 Wks @ 40° C. |
|---|---|---|---|---|---|---|
| 3–4 | Kelzan | 0.35 | 0.0 | 11.5 | 0.3 | 0.5 |
| 5–6 | Waterlock G-400 | 1.10 | 0.0 | 4.0 | 1.0 | 5.5 |
| 7–8 | Jaguar A40F | 0.70 | 0.0 | 47.5 | 1.0 | 27.0 |
| 9–10 | CMC 12M31P | 1.70 | 0.0 | 17.0 | 2.0 | 12.0 |

As seen above, the percent syneresis in the compositions without the bisulfite scavenger was significantly higher than that observed in the compositions containing sodium bisulfite. It was further observed that the xanthan gum (Kelzan) based composition containing sodium bisulfite (Example 4) had significantly less syneresis after four weeks than any of the other biodegradable structurant based compositions containing sodium bisulfite (Examples 6, 8 and 10). It is further observed that the xanthan gum structurant was present in the composition at levels of 0.35% of the total composition.

EXAMPLE 12

Two additional compositions were prepared as described in Example 1 each using microbial polysaccharide structurants, i.e. 0.50 wt. % Rhamsan K1A112 and 0.4 wt. % Whelan K1A96 supplied by Kelco Corp. The composition containing 0.50 wt. % Rhamsan® polysaccharide provided a composition having 7,800 cps while the composition containing 0.40 wt. % Whelan® polysaccharide provided a composition with 5,950 cps. Some phase separation was observed for each composition.

EXAMPLE 13

Wax encapsulates containing varying amounts of plasticizer (i.e., Hercolyn) and coating (i.e., Hubersorb or Silox) were prepared as described in Example 1 and tested to observe the percent of clearon CDB-56 chlorine bleach (CDB) remaining in the encapsulates after 12 weeks at 40° C. The observed results are presented in Table II as follows:

TABLE II

| Capsule Batch | Coating | Plasticizer | % CDB After 12 Weeks at 40° C. |
|---|---|---|---|
| 1 | 0.75 wt % Hubersorb | 1% Hercolyn | 94.8 |
| 2 | 0.75 wt % Hubersorb | None | 83.5 |
| 3 | 0.75 wt % Hubersorb | 1% Hercolyn | 85.4 |
| 4 | 2.00% Silox 15[1] | 1% Hercolyn | 67.8 |
| 5 | None | 1% Hercolyn | 75.0 |

[1]Silox 15 is a silica supplied by Dow Corning of Midland, MI.

Five compositions based on 0.5 wt. % Kelzan® Xanthan gum structurant; 0.1% sodium bisulfite and the encapsulates of batches 1–5 were prepared as described in Example 1.

Syneresis of each of the compositions was observed after weeks at both room temperature and 40° C. and presented in Table III as follows:

TABLE III

| Capsule Batch | % Syneresis 4 Wks Room Temp | % Syneresis 4 Wks 40° C. |
|---|---|---|
| 1 | 0.0 | 0.0 |
| 2 | 0.0 | 1.5 |

TABLE III-continued

| Capsule Batch | % Syneresis 4 Wks Room Temp | % Syneresis 4 Wks 40° C. |
|---|---|---|
| 3 | 0.3 | 0.5 |
| 4 | 0.3 | 3.0 |
| 5 | 0.5 | — |

Compositions containing encapsulates made with both Hercolyn and Hubersorb had less syneresis than those containing encapsulates not having both components. The former encapsulates exhibited more integrity, less hypochlorite leakage and greater product stability in combination with sodium bisulfite, a chlorine scavenger agent.

EXAMPLE 14

A composition structured with xanthan gum (Kelzan®) was compared in wash performance to compositions containing Carbopol (the cross-linked polyacrylate) as the structurant.

One of the criteria used to judge the performance of a dishwasher detergent is glassware appearance after washing. In this procedure, ten glass tumblers were placed in a Kitchen Aid® dishwasher. Forty grams of a 4:1 mixture of margarine and powdered milk were placed in the dishwasher. 40 grams of each of the Kelzan based and the Carbopol based compositions were added to the dishwasher dispenser cups. The water used contained 110 to 120 ppm hardness reported as $CaCO_3$. After repeating the test through 3 wash cycles, glasses were visually inspected and rated. They were rated numerically for spotting and filming on a scale of 0 to 4 (0=best; 4=worst) for spotting, and 0 to 5 (0=best; 5=worst) for filming. This process was repeated through 12 wash cycles. Differences of about 0.5 in spotting, and 1.0 in filming are considered significant.

The following results were obtained and presented in Table IV below,

TABLE IV

| | Kelzan | Carbopol |
|---|---|---|
| Average Spotting | 1.3 | 1.5 |
| Average Filming | 0.6 | 1.0 |
| Total Spotting | 5.1 | 5.9 |
| Total Filming | 2.3 | 3.9 |

As noted above, there is no significant difference in performance in either spotting or filming of the xanthan gum based composition vs, the polymeric based composition,

We claim:

1. A liquid automatic dishwashing detergent composition comprising:

(a) 0.1 to 0.35 wt. % of a xanthan gum;

(b) 10 to 40 wt. % of a builder;

(c) 0 to about 25 wt. % of an alkalinity agent;

(d) 0.01 wt. % to 1 wt. % of a chlorine scavenger agent;

(e) about 0.2 to about 3.0 wt. % available chlorine provided in wax encapsulates, each encapsulate prepared in a fluidized bed having a coherent paraffin wax coating which is stable in an alkaline environment; and (f) water.

2. The composition according to claim 1, wherein the chlorine scavenger agent is sodium bisulfite.

3. The composition according to claim 1, wherein the alkalinity agent is sodium disilicate having a ratio of SiO2:Na2O of from about 1.0 to about 3.3 and is present in an amount of 3 to about 20 wt. %.

4. The composition according to claim 1 wherein the encapsulates further comprise 1% of a hydrogenated methyl ester of resin and 0.75 wt. % a calcium silicate.

5. The composition according to claim 4 wherein about 50 wt. % of the encapsulates is the paraffin wax coating.

6. A liquid automatic dishwashing detergent composition comprising:

(a) 0.1 wt. % to 0.35 wt. % of a xanthan gum;

(b) 10 to 40 wt. % of a builder;

(c) 0 to about 25 wt. % of an alkalinity agent;

(d) 0.01 wt. % to 1 wt. % of a chlorine scavenger agent;

(e) about 0.2 to about 3.0 wt. % available chlorine provided in wax encapsulates, each encapsulate having a coherent paraffin wax coating which is stable in an alkaline environment; and (f) water.

7. A method of washing dishware using a liquid automatic dishwashing compositions having the following formula:

(a) 0.1 to 0.35 wt. % of a xanthan gum;

(b) 10 to 40 wt. % of a builder;

(c) 0 to about 25 wt. % of an alkalinity agent;

(d) 0.01 wt. % to 1 wt. % of a chlorine scavenger agent;

(e) about 0.2 to about 3.0 wax wt. % available chlorine source provided as a wax encapsulate, each encapsulate prepared in a fluidized bed and having a coherent paraffin wax coating which is stable in an alkaline environment; and (f) water;

wherein said dishware is contacted with said composition in an aqueous dishwashinq liquor.

8. The method according to claim 7 wherein the chlorine scavenger agent is sodium bisulfite.

9. The method according to claim 7 wherein the encapsulates further comprise 1% of a hydrogenated methyl ester of a resin and 0.75 wt. % of a calcium silicate.

10. The method according to claim 9 wherein about 50 wt. % of the encapsulates is the paraffin wax coating.

* * * * *